US012201917B2

(12) United States Patent
Von Heland

(10) Patent No.: US 12,201,917 B2
(45) Date of Patent: Jan. 21, 2025

(54) THROWING OBJECT

(71) Applicant: Waboba AB, Stockholm (SE)

(72) Inventor: Axel Von Heland, Enskededalen (SE)

(73) Assignee: Waboba AB, Stockholm (SE)

( * ) Notice: Subject to any disclaimer, the term of this patent is extended or adjusted under 35 U.S.C. 154(b) by 189 days.

(21) Appl. No.: 17/797,043

(22) PCT Filed: Feb. 4, 2020

(86) PCT No.: PCT/EP2020/052728
§ 371 (c)(1),
(2) Date: Aug. 2, 2022

(87) PCT Pub. No.: WO2021/155910
PCT Pub. Date: Aug. 12, 2021

(65) Prior Publication Data
US 2023/0065969 A1 Mar. 2, 2023

(51) Int. Cl.
*A63H 33/18* (2006.01)

(52) U.S. Cl.
CPC ..... *A63H 33/18* (2013.01)

(58) Field of Classification Search
CPC ..... A63H 33/18
See application file for complete search history.

(56) References Cited

U.S. PATENT DOCUMENTS 3,246,776 A 4/1966 Spencer et al.
3,264,776 A 8/1966 Morrow
4,151,674 A 5/1979 Klahn et al.
4,790,788 A 12/1988 Hill
4,850,923 A 7/1989 Etheridge
5,152,709 A 10/1992 Johnson, III et al.
5,397,261 A 3/1995 Malewicki et al.
5,810,637 A 9/1998 Mileti
5,816,880 A 10/1998 Forti et al.
6,048,245 A 4/2000 Forti et al.
(Continued)

FOREIGN PATENT DOCUMENTS

CN 202460134 U 10/2012
CN 203556150 U 4/2014
(Continued)

OTHER PUBLICATIONS

International Search Report and Written Opinion dated Oct. 7, 2020, issued in corresponding International Patent Application No. PCT/EP2020/052728.
Chinese Office Action dated Oct. 25, 2023 issued in corresponding Chinese Patent Application No. 2020800954348 (with English translation).
(Continued)

*Primary Examiner* — John A Ricci
(74) *Attorney, Agent, or Firm* — Harness, Dickey & Pierce, P.L.C.

(57) ABSTRACT

A throwing object comprises a hollow front element and a hollow tail element attached to the front element, wherein the front element comprises a first and a second section, each section being cylinder shaped, where the first section has a larger radius than the second section and is folded over the second section at an edge between the sections, the first section having a first thickness T1 and stretching a first distance d1 in an axial direction away from the edge and the second section having a second thickness T2 at the edge and the tail element being inserted and held between the first and second sections.

20 Claims, 3 Drawing Sheets

(56) References Cited

U.S. PATENT DOCUMENTS

| | | | | |
|---|---|---|---|---|
| 6,083,128 | A | 7/2000 | Young et al. | |
| 6,679,748 | B2 * | 1/2004 | Forti | A63H 33/18 446/61 |
| 11,623,161 | B2 * | 4/2023 | Gates | A63H 33/18 446/34 |
| 2003/0162469 | A1 | 8/2003 | Forti et al. | |
| 2007/0077857 | A1 | 4/2007 | Wright | |
| 2007/0197318 | A1 | 8/2007 | Serrano | |
| 2012/0267854 | A1 | 10/2012 | Lopatka | |
| 2014/0329432 | A1 | 11/2014 | Lopatka | |
| 2023/0051679 | A1 | 2/2023 | Gates et al. | |
| 2023/0356064 | A1 | 11/2023 | DeCruz | |

FOREIGN PATENT DOCUMENTS

| | | | |
|---|---|---|---|
| CN | 204319777 | U | 5/2015 |
| JP | H10-127954 | A | 5/1998 |
| KR | 20-2010-0009564 | U | 9/2010 |

OTHER PUBLICATIONS

Japanese Office Action dated Dec. 5, 2023 issued in corresponding Japanese Patent Application No. 2022-544143 (with English translation).

Chinese Office Action dated Mar. 15, 2024 issued in corresponding Chinese Patent Application No. 2020800954348 (with English translation).

Japanese Office Action dated May 21, 2024 for corresponding Japanese Application No. 2022-544143, and English-language translation thereof.

Chinese Notice of Grant including Search Report dated May 21, 2024 for corresponding Chinese Application No. 202080095434.8, and English-language translation thereof.

Liu Llang, "Analysis and response to technical trade measures on toys in Europe and the United States", Toy World, Issue 06, pp. 29-33, Jun. 15, 2012, and English-language translation thereof.

Jun, New Toy—Flying Ring, World Knowledge, Issue 10. Retrieved May 21, 2024.

* cited by examiner

THROWING OBJECT

CROSS-REFERENCE TO RELATED APPLICATIONS

This application is a national phase under 35 U.S.C. § 371 of PCT International Application No. PCT/EP2020/052728 which has an International filing date of Feb. 4, 2020, the entire contents of each of which are hereby incorporated by reference.

TECHNICAL FIELD

The invention relates to a throwing object comprising a hollow front element and a hollow tail element.

BACKGROUND

Throwing objects such as Frisbees™ are popular to use for recreational purposes.

However, also other types of throwing objects have become of interest for such recreational purposes. One throwing object is the Gyroscopic Flying Device, which is disclosed in U.S. Pat. Nos. 5,816,880 and 6,048,245.

This device which is provided in the form of a ring has also been used as a first element of a throwing object that is joined to a second element, where the second element is a nylon cloth. In this case the first element forms a front and the second element forms a tail of the throwing object.

The object functions well, however it would be of interest to improve on its behaviour in air.

SUMMARY

The present invention addresses the problem of providing an improved throwing object comprising a hollow front and a hollow tail.

This is according to a first aspect achieved through a throwing object comprising a hollow front element and a hollow tail element attached to the front element, wherein the front element comprises a first and a second section, each section being cylinder shaped and where the first section has a larger radius than the second section and is folded over the second section at an edge between the sections, the first section having a first thickness T1 and stretching a first distance d1 in an axial direction away from the edge and the second section having a second thickness T2 at the edge and the tail element being inserted and held between the first and second sections.

The first distance d1 may be in the range 17-25 mm and with advantage 21 mm. The second distance d2 may in turn be in the range 13-17 and with advantage 14.7 mm.

The first thickness T1 may be in the range 0.5-0.9 mm and with advantage 0.7 mm. The second thickness T2 may be in the range to 1.0-1.5 and with advantage 1.25 mm. The second thickness T2 may be higher than the first thickness T1. It may with advantage be 1.1-3 times higher and preferably 1.8 times higher than the first thickness T1.

The thickness of the second section may additionally be variable and increase in the axial direction away from the edge until a point of maximum thickness MT and thereafter decrease, thereby defining a bulge placed at a second distance d2 from the edge. The maximum thickness may be in the range 2.0-2.3 and with advantage 2.15 mm. The maximum thickness may additionally be in the range 4/3-2.3 times thicker and with advantage 1.72 times thicker than the second thickness T2 at the edge. The maximum thickness may additionally be in the range 2.2-4.6 and with advantage 3.9 times the first thickness T1.

The first distance d1 may be in the range 1-1.9 times longer than the second distance d2 and with advantage 1.4 times longer.

The diameter D of the second section at the edge may be in the range 63-80 mm and may with advantage be 68 mm. The diameter at the edge may additionally be in the range 3.8-6.2 and preferably 4.7 times higher than the second distance d2. It may additionally be in the range 28-40 and with advantage 32 times higher than the maximum thickness MT of the second section. The diameter of the second section at the edge may furthermore be in the range 1.5-2.7 and preferably 1.9 times higher than the sum of the first and second distances d1 and d2.

It is additionally possible that the sum of the maximum thickness MT of the second section and the first thickness T1 of the first section is 1.16-2.13 and with advantage 1.46 times higher than the sum of the first and second thicknesses T1, and T2.

The front element may additionally comprise a third section joined to the second section, where this joining may be made via an optional cut. The third section may have a third thickness $T_3$ that may be essentially the same as the first thickness T1 and the third section may stretch a third distance d3 away from the second section in the axial direction. The third distance d3 may be in the range 20-25 and with advantage 22.7 mm.

The sum of the maximum thickness MT of the second section and the first thickness T1 of the first section may be 3.1-4.5 and preferably 3.9 times higher than the third thickness $T_3$. The sum of the first and second thicknesses T1 and T2 may be 1.9-3.6 and preferably 2.7 times higher than the third thickness T3.

A first expression may be 1.5-5 and preferably 2.6 times higher than a second expression, where the first expression may comprise the first distance d1 subtracted from a sum of the second and third distances d2 and d3 and the second expression may comprise the second distance d2 subtracted from the first distance d1.

The tail element may be a cloth made of a natural or synthetic fibre, where cotton and silk are examples of natural fibres and nylon and polyester.

The front element may be made of an elastomer, such as silicone, rubber, a thermoplastic elastomer or a thermoplastic rubber such as TPU. The front element may additionally have a shore A hardness in the range 90-100 and preferably of 95.

The invention has a number of advantages. It provides a throwing object that is capable of gliding in the air with excellent aerodynamic properties.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
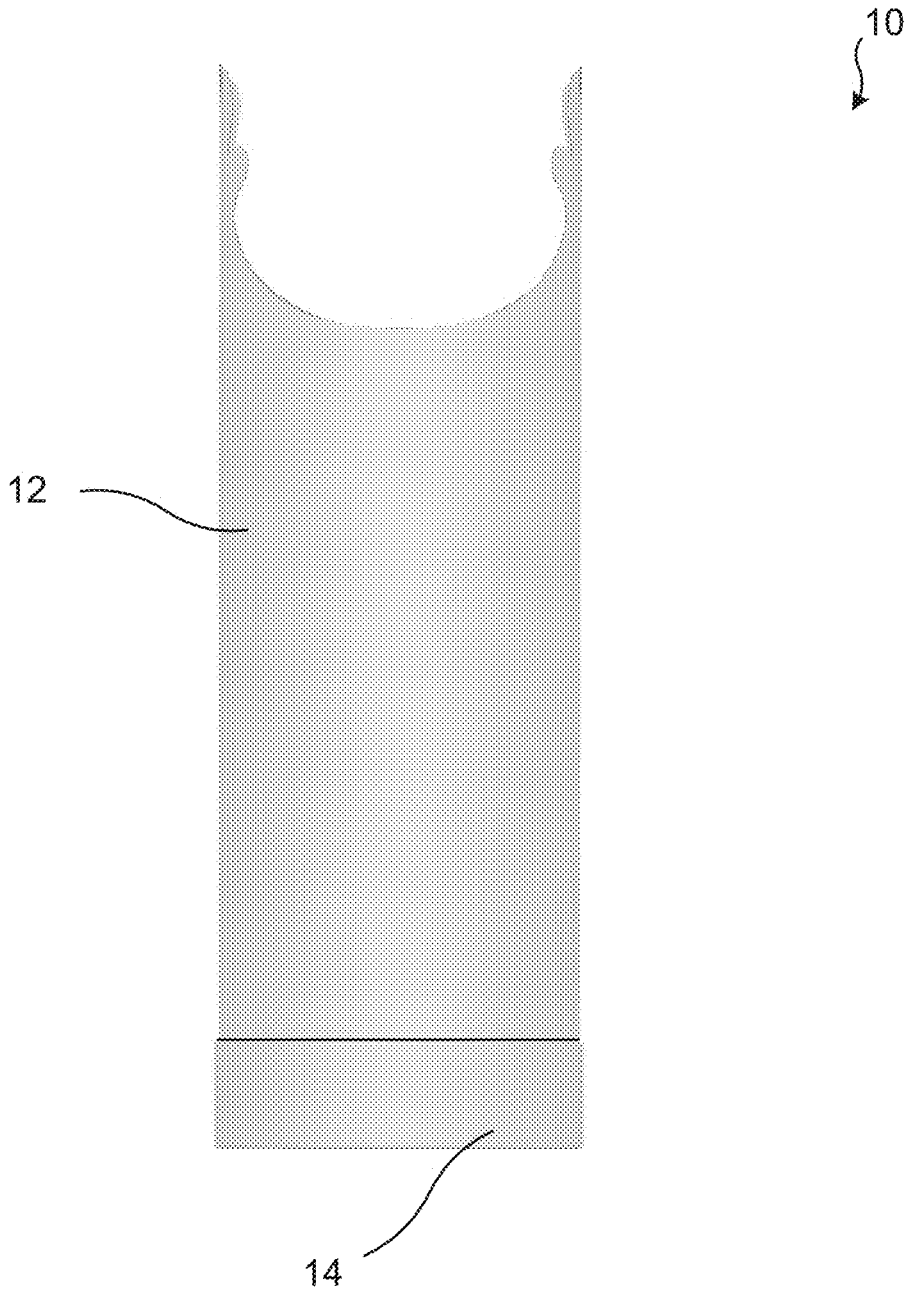
FIG. 1 shows a front view of a throwing object comprising a hollow front and a hollow tail.

FIG. 1 schematically shows a front view of a throwing object 10 that comprises a first and a second hollow element 12 and 14, where the first element is a hollow front 14 and the second element is a hollow tail 12 attached to the hollow front 14. The front may be ring-shaped, i.e. annular, or cylindrical and may be made of a material that is an elastomer, such as silicone, rubber, a thermoplastic elastomer or a thermoplastic rubber such as thermoplastic polyurethane (TPU). The material may additionally have a shore A hardness in the range 90-100 and preferably of 95.

The tail 12 may in turn be made of a cloth, which cloth may be made of natural fibres such as cotton or silk or synthetic fibres such as nylon or polyester.

The throwing object 10 is supposed to be thrown by a user and when being thrown, it is intended to glide in the air and therefore the tail 12 is attached to the front 14.

In the following an embodiment will be described where the tail is a nylon cloth and the front is a silicone front.

Figure 2:
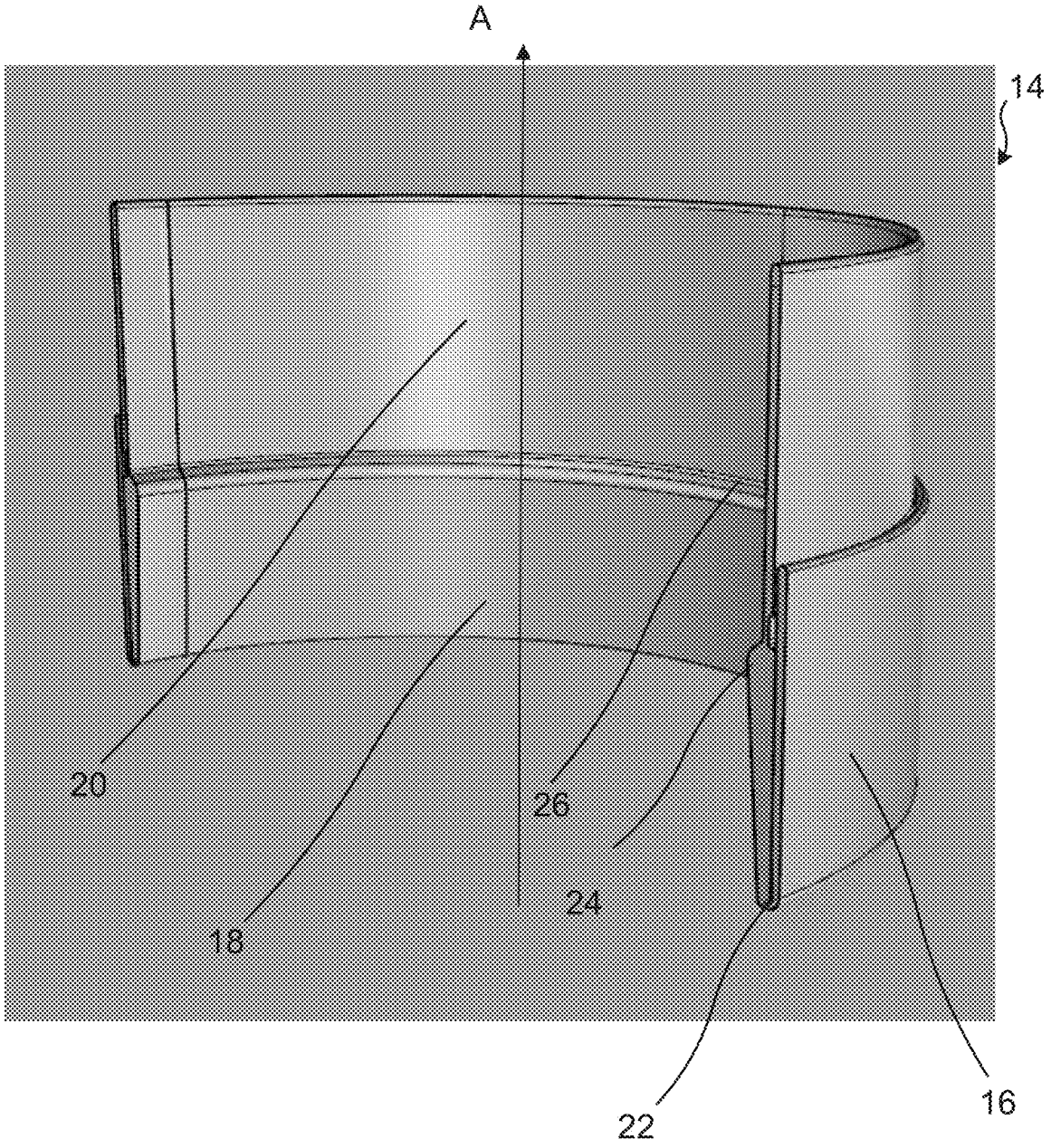
FIG. 2 shows a first perspective view of half the hollow front.
Figure 3:
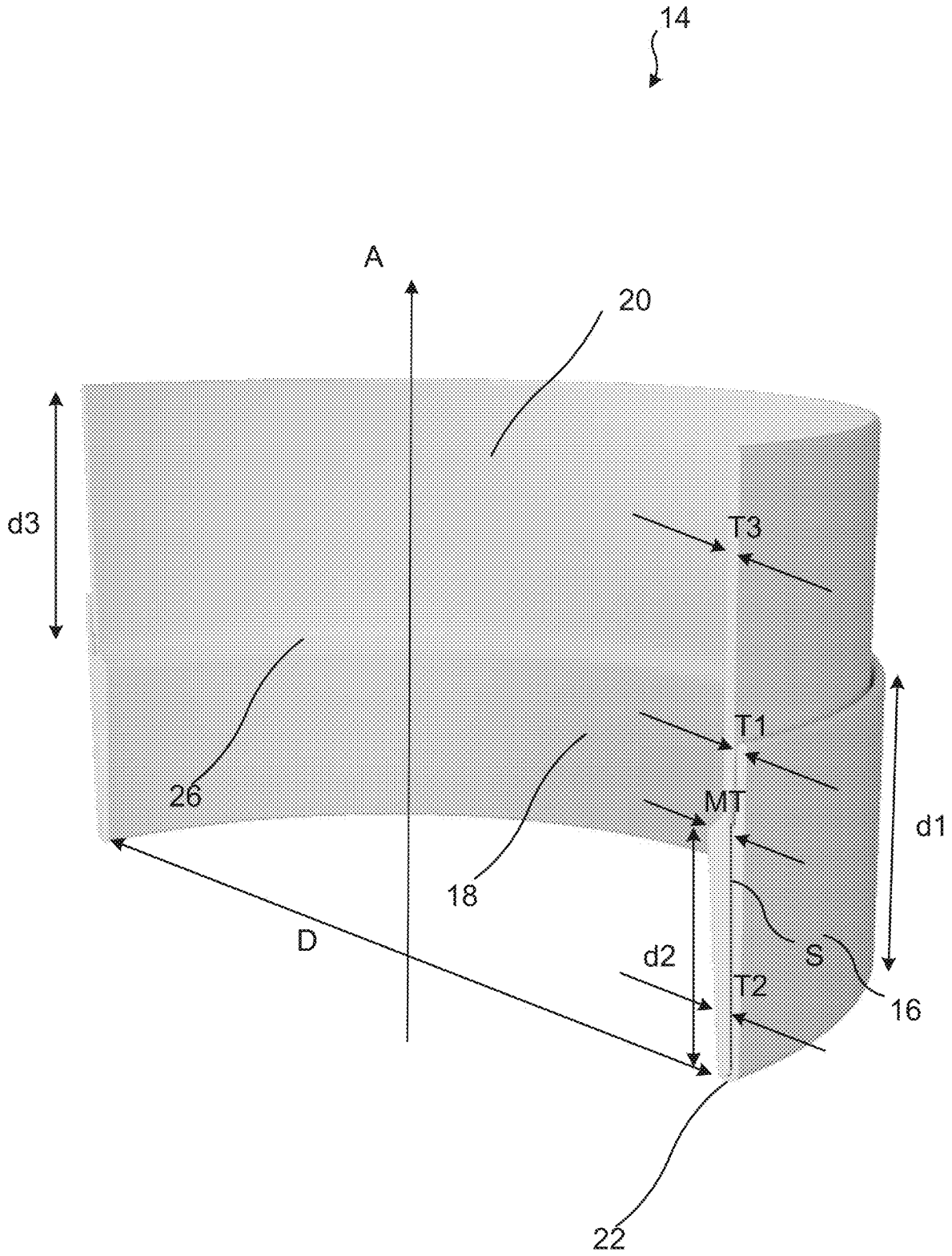
FIG. 3 shows a second perspective view of the hollow front half.

The structure of the front 14 of the embodiment can better be seen in FIGS. 2 and 3, which both show perspective views of the front 14 that has been cut in half.

As can be seen the front 14 comprises a first, second and third section 16, 18 and 20, where each section has a cylinder shape and therefore each section has a diameter, where the diameter D of the second section at an edge 22 is shown in FIG. 3. The first section 16 is additionally folded over the second section 18 at the edge 22. Moreover, the first section 16 has a larger diameter than the second section 18. The third section 20 is in turn joined to second section 18 via a cut 26. Thereby a longitudinal axis A is defined through the centre of the front 14 and the sections 16, 18 and 20 are centred around this axis A. Furthermore, the first section 16 is also concentric with the second section 18 and placed radially outside of the second section 18. It can thereby also be seen that the front has a circular cross-section.

The first section 16 has a first thickness T1 and stretches a first distance d1 in the axial direction away from the edge 22. The second section 18 in turn has a second thickness T2 at the edge 22. There is also a second distance d2 associated with the second section 18. The third section 20 has a third thickness $T_3$ that is essentially the same as the first thickness T1. The third section 20 also stretches a third distance $d_3$ away from the second section 18 in the axial direction.

Through this realization of the first and second sections 16 and 18, a slot S is defined between them and this slot S is configured to receive and hold the tail 12. When the throwing object 10 is assembled, the tail 12 is thus inserted and held in the slot S between the first and second sections 16 and 18 of the front 14.

The thickness of the second section 18 is variable and increases in the axial direction away from the edge 22 until a point of maximum thickness MT. Thereafter the thickness of the second section 18 decreases until the section 18 is joined to the third section 20 via the slot 26. This thickness variation is only observable in the interior of the front 14, i.e. on a surface facing the axis A, but not on a surface facing the first section 16. This means that an outer diameter of the second section 18 is fixed, while an inner diameter D of the second section 18 changes along the axis from the edge 22 towards the third section 20. More particularly, the inner diameter decreases from the edge 22 towards the point of maximum thickness MT and then increases from the point of maximum thickness MT towards the slot 26. The slope of the increase may be smaller than the slope of the decrease. The increase and decrease may be a linear increase and decrease. Therefore, the absolute value of the derivate of the diameter decrease may be smaller than the absolute value of the diameter increase.

The point of maximum thickness MT may be provided at the second distance d2 from the edge 22. The third section 20 may in turn stretch a third distance d3 along the axis A away from the second section 18.

Through the change of thickness there is a bulge 24 defined at the point of maximum thickness MT. The bulge is thereby placed on the second distance d2 along the axis A in a direction away from the edge 22. This bulge 24 has the advantage of allowing a thin throwing object to made that retains its shaped when in use while at the same time also retaining its aerodynamic properties.

The distance of this bulge 24 from the edge can be varied. However typically the bulge is placed at an upper end of the second section adjacent the third section, i.e. essentially as far away from the edge as possible.

The first distance d1 is typically in the range 17-25 mm and with advantage 21 mm. The second distance d2 is typically in the range 13-17 mm and with advantage 14.7 mm. The first thickness T1 is typically 0.5-0.9 mm and with advantage 0.7 mm. The thickness of the second section 18 at the edge 22, i.e. the second thickness T2, is typically in the range 1.0-1.5 and with advantage 1.25 mm. The maximum thickness MT of the second section 18 at the bulge 24 is in turn typically in the range 2.0-2.3 mm and with advantage 2.15 mm.

The inner diameter D of the second section 18 at the edge 22 is in turn typically in the range 63-80 mm and with advantage 68 mm.

With these dimensions it is additionally possible that the maximum thickness MT of the second section 18 is in the range of 4/3-2.3 times thicker and with advantage 1.72 times thicker than the second thickness T2 at the edge 22. It may also be in the range 2.2-4.6 and with advantage 3.1 times thicker than the first thickness T1.

The second thickness T2 is also higher (thicker) than the first thickness T1 and it is with advantage in the range 1.1-3 times higher (thicker) and with advantage 1.8 times higher (thicker) than the first thickness T1. The diameter D of the second section at the edge 22 is with advantage in the range 3.8-6.2 and with advantage 4.7 times higher than the second distance d2.

The diameter D of the second section at the edge 22 may additionally be in the range 28-40 and with advantage 32 times higher than the maximum thickness of the second section 18. The diameter D may furthermore be in the range 1.5-2.7 and preferably 1.9 times higher than the sum of the first and second distances d1 and d2. It is possible that these relationships are not applicable for higher diameters.

The first distance d1 may additionally be in the range 1.0-1.9 times longer than the second distance and with advantage 1.4 times longer. The sum of the maximum thickness MT of the second section and the first thickness T1 of the first section may additionally be in the range 1.16-2.13 and with advantage 1.46 times higher than the sum of the first and second thicknesses T1 and T2.

With these dimensions there is provided an annular or cylindrical front 14 that has good aerodynamic properties, where especially the size of the bulge and its placing along the axis A has been found to ensure that the throwing object can be thrown far, that it retains its shape and retains its aerodynamic properties. When the front is provided with a bulge in this way, it has been found that the circular cross-section is retained during use. The placing of the bulge at the second distance d2 from the edge in turn ensures that the aerodynamic properties of the front are retained. Thy are thus not degraded by the introduction of the bulge.

The third distance d3 is typically in the range 20-25 and with advantage 22.7 mm. The third thickness T3 is typically essentially the same as the first thickness T1. The sum of the maximum thickness MT of the second section 18 and the first thickness T1 of the first section 16 may additionally be in the range 3.1-4.5 and preferably 3.9 times higher than the third thickness T3.

The sum of the first and second thicknesses T1 and T2 may be in the range 1.9-3.6 and may preferably be 2.7 times higher than the third thickness $T_3$.

The first, second and third distances d1. d2 and d3 may furthermore be used to form a first expression and the first and second distances d1 and d2 may be used to form a second expression. The first expression may more particularly be formed as the first distance d1 subtracted from a sum of the second and third distances d2 and $d_3$, while the second expression may be formed as the second distance d2 subtracted from the first distance d1. The first expression may be in the range 1.5-5 and preferably 2.6 times higher than the second expression. The first expression thereby defines the amount of third section 20 that supports the part of the cloth 12 that faces the atmosphere, while the second expression defines an amount of overlap between the first and third sections 16 and 18.

With these latter dimensions there is provided a front 14 with a structure that safely holds the tail 12 and keeps it smooth outside the third section 20. This also has a beneficial influence on the aerodynamic properties of the throwing object 10.

There are a number of variations that may be made to the invention apart from those already disclosed. It is possible with other types of thickness variations of the second section than linear. It is for instance possible to use exponential and/or parabolic thickness variations. It is also possible that there is no cut between the second and third sections. It is actually even possible that the third section is omitted.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. A throwing object, comprising:

a hollow front element; and a hollow tail element attached to the hollow front element, wherein the hollow front element includes a first section and a second section, each section of the first section and the second section being cylinder shaped, where the first section has a larger radius than the second section and is folded over the second section at an edge between the first section and the second section, the first section having a first thickness T1 and stretching a first distance d1 in an axial direction away from the edge and the second section having a second thickness T2 at the edge and the hollow tail element being inserted and held between the first section and the second section, wherein the throwing object further includes a third section joined to the second section, wherein the third section has a third thickness T3 that is essentially a same thickness as the first thickness and stretches a second distance d2 away from the second section in the axial direction.

2. The throwing object according to claim 1, wherein the second thickness T2 is higher than the first thickness T1.

3. The throwing object according to claim 2, wherein the thickness of the second section is variable and increases in the axial direction away from the edge until a point of a maximum thickness MT and thereafter decreases, thereby defining a bulge placed at a third distance d3 from the edge, wherein the maximum thickness MT is 4/3-2.3 times thicker than the second thickness T2 at the edge.

4. The throwing object according to claim 3, wherein the first distance d1 is in a range of 1-1.9 times longer than the third distance d3.

5. The throwing object according to claim 3, wherein a diameter D of the second section is in a range of 63-80 mm.

6. The throwing object according to claim 3, wherein a diameter D of the second section is 3.8-6.2 times higher than the third distance d3.

7. The throwing object according to claim 3, wherein a diameter D of the second section is 1.5-2.7 times higher than a sum of the first distance d1 and the third distance d3.

8. The throwing object according to claim 3, wherein a sum of the maximum thickness MT of the second section and the first thickness T1 of the first section is 1.16-2.13 times higher than a sum of the first thickness T1 and the second thickness T2.

9. The throwing object according to claim 8, wherein the sum of the maximum thickness MT of the second section and the first thickness T1 of the first section is 1.46 times higher than the sum of the first thickness T1 and the second thickness T2.

10. The throwing object according to claim 3, wherein a sum of the maximum thickness MT of the second section and the first thickness T1 of the first section is 3.12-4.5 times higher than the third thickness T3.

11. The throwing object according to claim 10, wherein a first expression is 1.5-5 times higher than a second expression, where the first expression comprises the first distance d1 subtracted from a sum of the second distance d2 and the third distance d3 and the second expression comprises the third distance d3 subtracted from the first distance d1.

12. The throwing object according to claim 10, wherein the sum of the maximum thickness MT of the second section and the first thickness T1 of the first section is 3.9 times higher than the third thickness T3.

13. The throwing object according to claim 3, wherein the maximum thickness MT is 1.72 times thicker than the second thickness T2 at the edge.

14. The throwing object according to claim 2, wherein the second thickness T2 is 1.1-3 times higher than the first thickness T1.

15. The throwing object according to claim 14, wherein the second thickness T2 is 1.8 times higher than the first thickness T1.

16. The throwing object according to claim 1, wherein a sum of the first thickness T1 and the second thickness T2 is 1.9-3.6 times higher than the third thickness T3.

17. The throwing object according to claim 1, wherein the hollow tail element is a cloth, and the cloth is made of a natural fibre or a synthetic fibre.

18. The throwing object according to claim 1, wherein the hollow front element is an elastomer, such as silicone, rubber, a thermoplastic elastomer or a thermoplastic rubber such as TPU.

19. The throwing object according to claim 18, wherein the hollow front element has a shore A hardness in a range of 90-100.

20. The throwing object according to claim 19, wherein the hollow front element has a shore A hardness of 95.

* * * * *